US005666842A

United States Patent [19]

Komatsubara et al.

[11] Patent Number: 5,666,842

[45] Date of Patent: Sep. 16, 1997

[54] METHOD OF COLD ROLLING GRAIN-ORIENTED SILICON STEEL SHEET HAVING EXCELLENT AND UNIFORM MAGNETIC CHARACTERISTICS ALONG ROLLING DIRECTION OF COIL AND A ROLL COOLING CONTROLLER FOR COLD ROLLING MILL USING THE COLD ROLLING METHOD

[75] Inventors: Michiro Komatsubara; Yasuyuki Hayakawa; Humihiko Takeuchi; Masataka Yamada, all of Okayama, Japan

[73] Assignee: Kawasaki Steel Corporation, Japan

[21] Appl. No.: 375,558

[22] Filed: Jan. 19, 1995

[51] Int. Cl.[6] ..... B21B 27/06

[52] U.S. Cl. ..... 72/200; 72/201; 72/8.5

[58] Field of Search ..... 72/197, 198, 365.2, 72/366.2, 201, 8.5, 11.3, 364, 200, 202; 148/11, 13

[56] References Cited

U.S. PATENT DOCUMENTS

| | | | |
|---|---|---|---|
| 3,779,054 | 12/1973 | Greenberger | 72/201 |
| 3,933,024 | 1/1976 | Matsumoto et al. | 72/364 |
| 5,312,496 | 5/1994 | Ames | 72/366.2 |

*Primary Examiner*—Lowell A. Larson
*Assistant Examiner*—Rodney A. Butler
*Attorney, Agent, or Firm*—Austin R. Miller

[57] ABSTRACT

A method of manufacturing a grain-oriented silicon steel sheet having excellent and uniform magnetic characteristics by improving the magnetic flux density of a silicon coil cold rolled to a thin thickness without increasing a Si content. The method comprises controlling steel sheet temperature along the rolling direction of a coil immediately downstream of the outlet roll bites of one or more rolling paths to about 15° C. or less, and controlling the temperature of one or more of the rolling paths between about 150° C. to about 350° C.

11 Claims, 5 Drawing Sheets

METHOD OF COLD ROLLING GRAIN-ORIENTED SILICON STEEL SHEET HAVING EXCELLENT AND UNIFORM MAGNETIC CHARACTERISTICS ALONG ROLLING DIRECTION OF COIL AND A ROLL COOLING CONTROLLER FOR COLD ROLLING MILL USING THE COLD ROLLING METHOD

BACKGROUND OF THE INVENTION

1. Field of the Invention

The present invention relates to a method of cold rolling a grain-oriented silicon steel sheet having excellent and uniform magnetic characteristics along the rolling direction of a coil and a roll cooling controller for a cold rolling mill using the cold rolling method.

2. Description of the Related Art

Grain-oriented silicon steel sheet, which is mainly used as iron cores for transformers and generators, requires high magnetic flux density (often represented by the magnetic flux density existing in a magnetic field of 800 A/m: $B_8$) and low iron loss (represented by the iron loss in AC 50 Hz at a maximum magnetic flux density of 1.7 T: $W_{17/50}$).

In particular, when a grain-oriented silicon steel sheet is used in large transformers, it must have uniform material characteristics in order to improve its efficiency and noise level. Various efforts have been made to reduce iron loss. The following methods have proven effective:

(1) reducing the thickness of the steel sheet;

(2) increasing its Si content; and (3) reducing the grain size of secondary recrystallized grains in the final product.

The above improvements can produce a material having an iron loss $W_{17/50}$ of 90 W/kg from a product 0.23 mm thick.

It is difficult, however, to further reduce iron loss beyond those levels. Reducing the thickness of a steel sheet to less than 0.23 mm causes defective secondary recrystallization by which the iron loss value is caused to deteriorate. Increasing the silicon content makes cold rolling difficult, and decreasing average grain size to less than 4–8 mm causes defective secondary recrystallization by which the iron loss value deteriorates.

Although there has been improvement of magnetic characteristics along the rolling direction of the coil, no improvement has been achieved with respect to dispersion of magnetic characteristics.

Recently, great improvement in iron loss has been achieved by physically fractionating a magnetic domain by either locally introducing strain on the surface of the steel sheet, or by forming grooves thereon. For example, about 0.10 W/Kg can be eliminated at $W_{17/50}$ by introducing local strain on the surface of a steel sheet by applying a plasma jet.

To obtain a material having excellent iron loss properties by the physical fractionation method, it is not necessary to reduce the crystal grain size of the final product beyond that achieved in conventional methods, but it is necessary to reduce sheet thickness and to increase both Si content and magnetic flux density. Since it is difficult or even undesirable to further increase the Si content, the improvement of iron loss entirely depends on how the magnetic flux density of a material having a thin sheet thickness can be improved.

To improve the magnetic flux density of a grain-oriented silicon steel sheet, the orientation of the crystal grains of a product must be largely accumulated in the orientation (110) [001], i.e., in the so-called Goss orientation. The crystal grains in the Goss orientation of the grain-oriented silicon steel sheet can be obtained by secondary recrystallization in final finish annealing.

To cause secondary recrystallization, a so-called selective growth is employed so that only the crystal grains near to the (110) [001] orientation are grown and the growth of the crystal grains in the other orientations is suppressed. An inhibitor must be added to suppress the growth of the crystal grains of the other orientations by forming a dispersed precipitation phase in the steel which serves to suppress the growth of the undesired grains.

Since inhibitors having the strongest suppressing action also have the strongest selective growth effects, many studies have been directed to finding the most effective inhibitors to maximize magnetic flux density. AlN has been found to be the most effective inhibitor. As disclosed in Japanese Patent Publication No. 46-23820, a material having a high magnetic flux density of 1.92–1.95 T at $B_{10}$ can be obtained from a steel sheet containing Al in such a manner that the steel sheet annealed prior to final cold rolling is quenched and the rolling reduction in the final cold rolling is controlled to a heavy rolling reduction value of 80–95%.

Further, as disclosed in Japanese Patent Publication No. 63-11406, secondary recrystallization can be stabilized by the addition of Sn and Cu.

The inventions disclosed in above publications, however, improve the averaged characteristics of the steel along the rolling direction of the steel sheet but do not address variations of magnetic characteristics, which variations manifest themselves along the rolling direction of the coil.

We have investigated analytically the effects of cold rolling on the variations of magnetic characteristics as they occur along the rolling direction of a steel sheet.

With respect to rolling technology for grain-oriented silicon steel sheet, Japanese Patent Publication No. 50-37130 discloses a method involving setting the roll diameter used in a final cold rolling to 300 mmϕ or less.

Japanese Patent Application Laid-Open No. 2-80106 discloses a method for using work rolls having a diameter less than 250 mmϕ to a first stand in tandem rolling. Further, Japanese Patent Publication No. 54-13846 and Japanese Patent Publication No. 54-29182 disclose effecting an aging treatment between cold rolling paths. Further, Japanese Patent Publication No. 50-26493 and Japanese Patent Publication No. 3-23607 disclose regulating the temperature range of cold rolling.

Although the above disclosures effectively improve average magnetic characteristics to some degree and in some ways, they are not effective in stabilizing the magnetic characteristics along the rolling direction of a coil.

As described above, no effective means exists for producing grain-oriented silicon steel sheet having improved magnetic characteristics while suppressing its fluctuation along the rolling direction of the coil.

SUMMARY OF THE INVENTION

An object of the present invention is to provide a method of cold rolling grain-oriented silicon steel sheet having excellent magnetic characteristics while controlling variation of the magnetic characteristics along the rolling direction of the coil.

Another object of the invention is to provide a roll cooling controller for a cold rolling mill using this method.

We have discovered that, during cold rolling of steel sheet containing silicon, it is very effective to control the outlet temperature of the rolling mill, rather than the inlet temperature, as a rolling temperature, and that this can be made to firmly stabilize the magnetic characteristics of the steel along the rolling direction of the coil.

That is, according to the present invention, a method for cold rolling a grain-oriented silicon steel sheet having excellent and uniform magnetic characteristics along the rolling direction of a coil is taught. The method involves controlling the steel sheet temperature along the rolling direction of the coil immediately downstream of the outlet roll bite of a plurality of rolling paths within a range of about 15° C. or less with one or more of the rolling paths set to a temperature in the range of about 150° C. to about 350° C.

According to the present invention, we have discovered another method of cold rolling a grain-oriented silicon steel sheet having excellent and uniform magnetic characteristics along the rolling direction of the coil. The method involves controlling the steel sheet temperature along the rolling direction of a coil immediately downstream of the outlet roll bite of a plurality of rolling paths to within a range of about 7° C. or less with one or more of the rolling paths set to a temperature from about 150° C. or more to about 350° C. or less.

According to the present invention, we have discovered still another method of cold rolling a grain-oriented silicon steel sheet having excellent and uniform magnetic characteristics along the rolling direction of the coil. The method involves controlling the steel sheet temperature along the rolling direction of the sheet immediately downstream of the outlet roll bite of a plurality of rolling paths to within a range of about 15° C. or less. This range is maintained by controlling the flow rate of a coolant or coolants in the rolling path with one or more of the rolling paths set to a temperature in the range of about 150° C. to about 350° C.

According to the present invention, we have discovered still another method of cold rolling a grain-oriented silicon steel sheet having excellent and uniform magnetic characteristics along the rolling direction of the coil. The method involves controlling the steel sheet temperature along the rolling direction of a coil immediately downstream of the outlet roll bite of a plurality of rolling paths to within a range of about 15° C. or less by measuring the steel sheet temperature immediately downstream of the outlet roll bite of the rolling paths. This range is maintained by controlling the flow rate of a coolant or coolants to one or more rolls of the rolls constituting a cold rolling mill based on the measured steel sheet temperature so that the steel sheet temperature immediately downstream of the outlet roll bite of the rolling paths is kept constant. Additionally, one or more of the rolling paths set to a temperature in the range of about 150° C. to about 350° C.

According to the present invention, we have discovered still another method of cold rolling a grain-oriented silicon steel sheet having excellent and uniform magnetic characteristics along the rolling direction of the coil. The method involves controlling the steel sheet temperature along the rolling direction of a coil immediately downstream of the outlet roll bite of a plurality of rolling paths to within a range of about 7° C. or less. This range is maintained by controlling the flow rate of coolants in the rolling path with one or more of the rolling paths set to a temperature in the range of about 150° C. to about 350° C.

According to the present invention, we have discovered still another method of cold rolling a grain-oriented silicon steel sheet having excellent and uniform magnetic characteristics along the rolling direction of the coil. The method involves controlling the steel sheet temperature along the rolling direction of the sheet immediately downstream of the outlet roll bite of a plurality of rolling paths to within a range of about 7° C. or less by measuring the steel sheet temperature immediately downstream of the outlet roll bite of the rolling paths. The temperature range is maintained by controlling the flow rate of a coolant to any one or more rolls of the rolls constituting a cold rolling mill based on the measured steel sheet temperature so that the steel sheet temperature immediately downstream of the outlet roll bite of the rolling paths is kept constant. Additionally, one or more of the rolling paths set to a temperature in the range of about 150° C. to about 350° C.

According to the present invention, we have discovered still another method of cold rolling a grain-oriented silicon steel sheet having excellent and uniform magnetic characteristics along the rolling direction of the coil wherein the temperature of the first path is set to about 150° C. or less and temperatures are sequentially raised to at least the third path. The steel sheet temperatures are measured immediately downstream of outlet roll bites.

According to the present invention, we have discovered a roll cooling controller for a cold rolling mill which cold rolls grain-oriented silicon steel sheet having excellent and uniform magnetic characteristics along the rolling direction of the coil. The controller comprises a sensor for measuring the temperature on the upper surface or lower surface of a steel sheet immediately downstream of the outlet roll bite of rolling paths, a controller for producing a feedback signal so that the signal measured by the sensor is made to coincide with a target value, and a flow rate controller for controlling the flow rate of a coolant or coolants in accordance with a signal from the controller.

DETAILED DESCRIPTION OF THE INVENTION

Figure 1A:
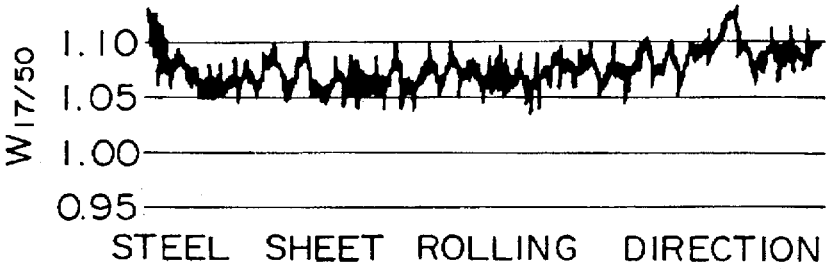
FIGS. 1A–1D is a series of graphs showing continuously measured iron loss values along the rolling direction of a coil in various types of cold rolling operations.

The present invention will be specifically described below on the basis of certain experiments which are intended to be illustrative of the invention but are not intended to limit the scope of the invention defined in the appended claims.

Four pieces of hot rolled coils of 1.90 mm thick each containing Si: 3.0%, C: 0.07%, Mn: 0.07%, and Al: 0.02% were subjected to hot rolled sheet annealing at 1150° C. for 60 seconds and then cooled with mist water at a speed of 40° C./sec.

Each of the four coils was cold rolled to a final thickness of 0.30 mm under different conditions.

First, in condition (a), the first coil was heated in a box furnace to 200° C. and finished to a thickness of 0.30 mm by a Sendzimir rolling mill having a work roll diameter of 80 mmϕ.

The first path: 1.90–1.40 mm (rolling reduction: 26%);

The second path: 1.40–1.00 mm (rolling reduction: 29%);

The third path: 1.00–0.70 mm (rolling reduction: 30%);

The fourth path: 0.70–0.50 mm (rolling reduction: 29%);

The fifth path: 0.50–0.38 mm (rolling reduction: 24%); and

The six path: 0.38–0.30 mm (rolling reduction: 21%)

In the rolling operation, the flow rate of coolants to wiper rolls and work rolls was held constant. The steel sheet had the following temperatures immediately downstream of the roll bite: the first path, 185°–206° C.; the second path, 215°–225° C.; the third path, 232°–246° C.; the fourth path, 241°–253° C.; the fifth path, 216°–223° C.; and the sixth path, 186°–193° C.

In condition (b), the second coil was finished to a thickness of 0.30 mm by the same rolling path schedule as condition (a) using a Sendzimir rolling mill having a work roll diameter of 80 mmϕ. The flow rate of coolants to wiper rolls and work rolls was held constant just as in condition (a).

Unlike condition (a), however, the second coil was not heated prior to rolling.

As a result, the steel sheet had the following temperatures immediately downstream of the outlet roll bite: the first path, 135°–167° C.; the second path, 188°–203° C.; the third path, 198°–223° C.; the fourth path, 184°–218° C.; the fifth path, 178°–197° C.; and the sixth path, 103°–146° C.

As condition (c), the third coil was finished to a thickness of 0.30 mm by the same rolling path schedule as the condition (a) using a Sendzimir rolling mill having a work roll diameter of 80 mmϕ. The steel sheet temperature immediately downstream of the outlet roll bite was measured and the flow rate of coolants to wiper rolls and work rolls was adjusted so that the temperature was held constant.

As a result, the temperature of the steel sheet could be controlled in the temperature range of the first path, 154°–155° C.; the second path, 192°–193° C.; the third path, 193°–194° C.; the fourth path, 202°–203° C.; the fifth path, 196°–197° C.; and the sixth path, 140°–141° C.

In condition (d), the fourth coil was finished to a thickness of 0.30 mm by the same rolling path schedule as the condition (a) using a Sendzimir rolling mill having a work roll diameter of 80 mmϕ. The steel sheet temperature was measured at the inlet roll bite and the flow rate of coolants to wiper rolls and work rolls was adjusted so that the measured temperature was held constant. As a result, the temperature at the inlet of the work roll bite could be controlled to 25°–26° C. in the first path, 136°–137° C. in the second path, 198°–199° C. in the third path, 198°–199° C. in the fourth path, 203°–204° C. in the fifth path and 168°–169° C. in the sixth path.

The four coils were subsequently degreased and then subjected to decarburizing annealing at 850° C. for two minutes in a wet hydrogen atmosphere containing 55% of $H_2$ and the balance $N_2$ with a dew point of 60° C. Thereafter, each of the coils was coated with MgO containing 5% of $TiO_2$ and 2% of $Sr(OH)_2 \cdot 8H_2O$ as an annealing separation agent, wound to a coil shape and subjected to final finish annealing comprising secondary recrystallization annealing at 840° C. in an $N_2$ atmosphere for 40 hours, then up to 1200° C. at a temperature increasing speed of 15° C./hr in an atmosphere containing 25% of $N_2$ and 75% of $H_2$ and subsequently to purification annealing at 1200° C. for five hours in an $H_2$ atmosphere. Thereafter, any unreacted annealing separation agent was removed, then tension coating was applied to each coil followed by a baking treatment at 800° C. for one minute (which also acted as a flattening annealing treatment). FIGS. 1A–1D show continuous measurement of iron loss along the rolling direction of these coils. FIG. 1A–FIG. 1D correspond to the cases under the above conditions (a)–(d), respectively.

For condition (a) where the steel sheet was heated prior to the start of rolling and the flow rate of the coolants was held constant, magnetic characteristics fluctuate greatly as shown in FIG. 1A.

Figure 1B:
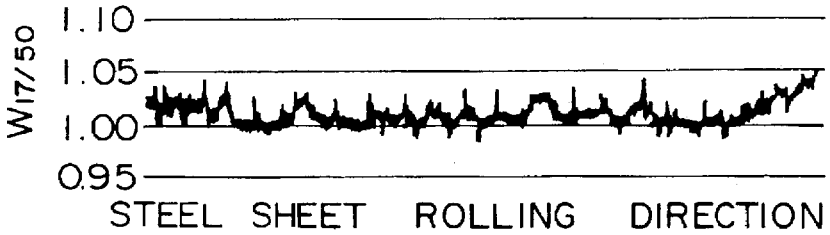

For condition (b) where the steel sheet was not heated prior to the start of rolling operation and the flow rate of the coolants was held constant, FIG. 1B shows magnetic characteristics which also fluctuate greatly although the degree of variation is smaller than that of the condition (a).

Figure 1C:
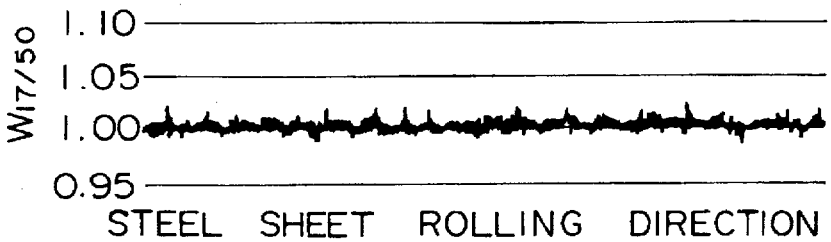

For condition (c) where the flow rate of the coolants was controlled such that the steel sheet had a constant temperature immediately downstream of the outlet roll bite in each rolling path, FIG. 1C shows stable and excellent magnetic characteristics with little variation in iron loss.

Figure 1D:
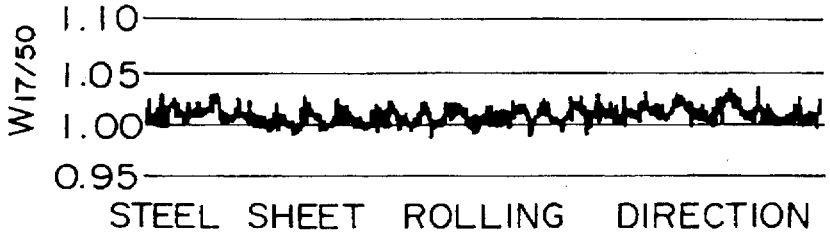

For condition (d) where the steel sheet temperature was controlled at the inlet roll bite in each roll path, FIG. 1D shows large fluctuations in iron loss.

The restricting of iron loss fluctuation as described in condition (c) can be accomplished contemporaneously with restricting in sheet thickness fluctuation.

The inventors performed the following experiment to determine why magnetic characteristics were improved and stabilized as described above by keeping the steel sheet temperature constant immediately downstream of outlet roll bites.

Figure 2:
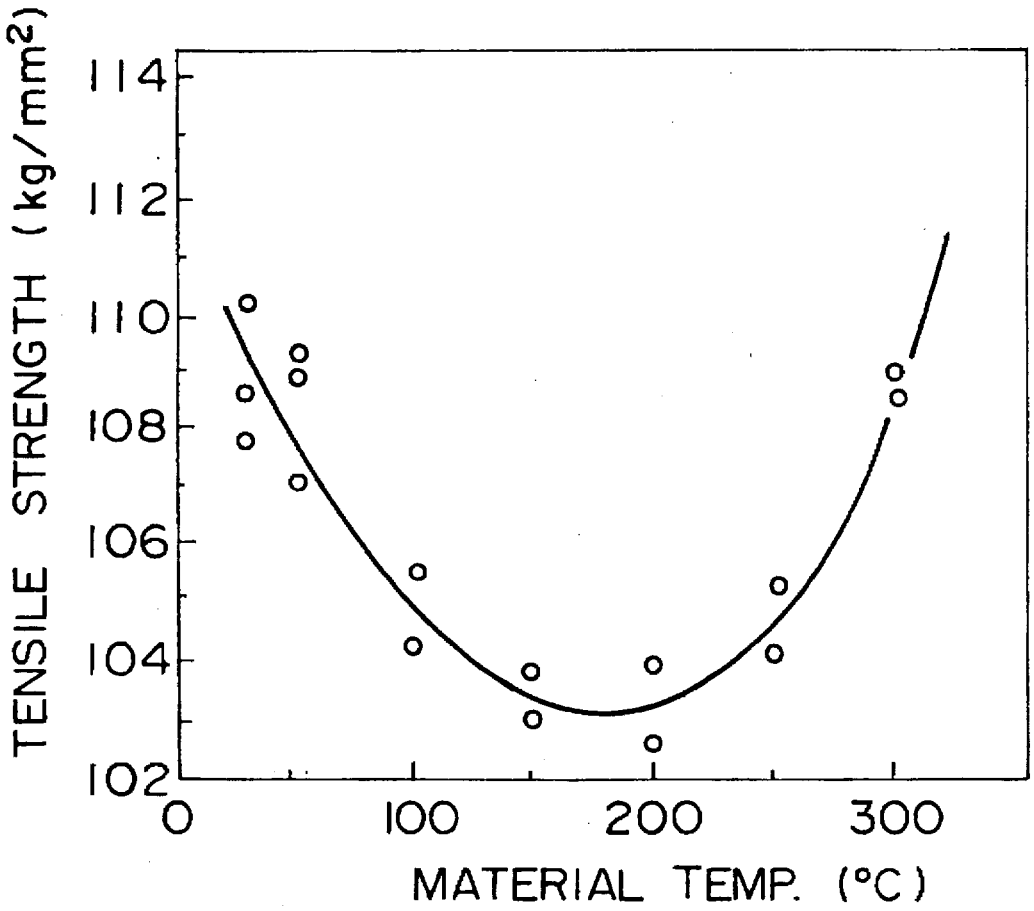
FIG. 2 is a graph showing the relationship between tensile strength and material temperature of steel used in a tensile strength test.

A cold rolled sheet of 0.75 mm thick containing C: 0.06%, Si: 3.2%, Mn: 0.07%, Al: 0.02% and N:0.008% was subjected to a tensile test while maintaining a constant material temperature. FIG. 2 shows the result of the test.

As shown in FIG. 2, when the material temperature was increased from room temperature, the tensile strength of the sheet abruptly declined until the temperature reached 200° C., and increased again above 200° C. This indicates that small changes in rolling temperature have large effects on the deformation resistance of a material.

One reason why the magnetic characteristics were improved and stabilized can be deduced from the results of the experiment. Tensile strength is altered by changing the working temperature because the number of slip deformation modes of a material is altered by changes in working temperature. Tensile strength decreases as material temperature increases because the number of slip deformation modes increase and a multiple slip occurs. Rolled texture is changed by rolling deformation caused by the change in the number of deformation modes, thus altering recrystallization texture after annealing which fluctuates the magnetic characteristics of the steel. Consequently, rolling temperature must be controlled to a constant value to stabilize magnetic characteristics.

Further, since tensile strength in relation to material temperature is varied by tensile working and accumulated working strain, the optimum temperature may be different for each path depending upon the difference of rolling reduction in each path. Not only can the variation of magnetic characteristics be minimized, but the magnetic characteristics themselves can be improved by maintaining the temperatures in the vicinity of the optimum temperature.

Figure 3A:
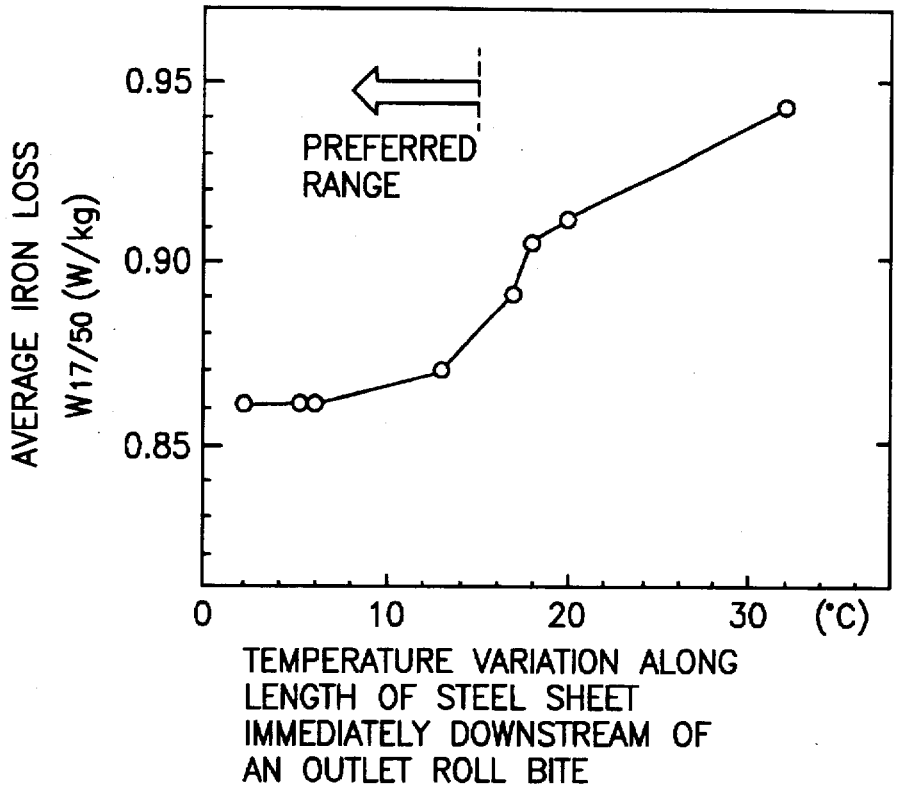
FIG. 3A is a graph showing the relationship between the temperature variation of a steel sheet immediately downstream of an outlet roll bite and the average iron loss.
Figure 3B:
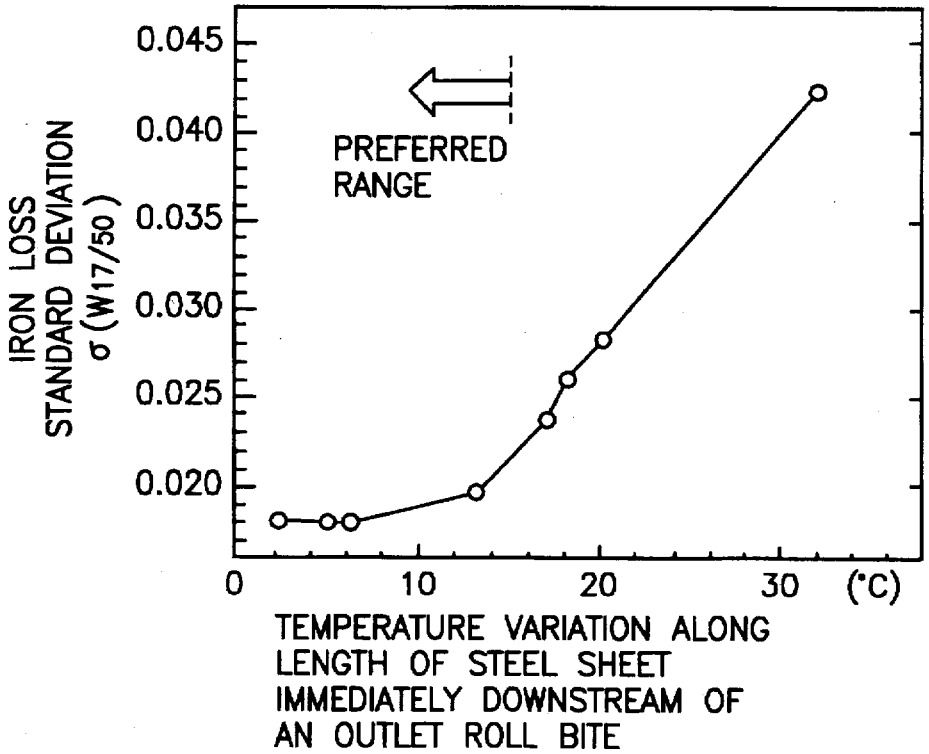
FIG. 3B is a graph showing the relationship between the temperature variation of a steel sheet immediately downstream of an outlet roll bite and the standard deviation of iron loss.

FIGS. 3A and 3B shows the effect on magnetic characteristics of temperature variation in steel sheet immediately downstream of outlet roll bites.

As shown in FIGS. 3A and 3B, when the steel sheet temperature varies in the range of from 1° C. to 7° C., average iron loss and the iron loss standard deviation are very good. However, when the range of the temperature variation is 15° C. or higher, these values abruptly deteriorate.

Consequently, the temperature variation of a steel sheet immediately downstream of outlet roll bites is preferably controlled to a range of about 15° C. or less and most preferably to a range of about 7° C. or less to minimize the fluctuation in magnetic characteristics as well as improve the magnetic characteristics.

Experiments were performed to determine target rolling temperatures in each rolling path for further improving magnetic characteristics when the aforesaid cold rolling method was employed.

Eight pieces of steel slab each containing C: 0.065%, Si: 3.35%, Mn: 0.07%, P: 0.003%, Al: 0.025%, S: 0.002%, Sb: 0.040%, N: 0.008%, Bi: 0.005% and the balance iron with associated impurities were soaked at 1420° C. and then rolled to hot rolled coils 2.2 mm thick by a conventional method. Each of the hot rolled coils was subjected to hot rolled sheet annealing at 1000° C. for 50 seconds, then rolled through four paths by a four-stand tandem rolling mill while controlling the steel sheet temperature immediately downstream of the outlet roll bites by controlling the flow rate of coolants. Each coil was rolled to have an intermediate thickness of 1.50 mm with the steel sheet temperature controlled to 105° C. (range of variation: 7° C.) in the first path; 135° C. (range of variation: 6° C.) in the second path; 168° C. (range of variation: 7° C.) in third path; and 63° C. (range of variation: 5° C.) in fourth path. Thereafter, each coil was subjected to intermediate annealing at 1130° C. for 60 seconds and cooled at 40° C./sec in mist water.

Thereafter, each coil was rolled to a final sheet thickness of 0.20 mm by a Sendzimir rolling mill through five paths with the first path: 1.00 mm (rolling reduction: 33%), the second path: 0.65 mm (rolling reduction: 35%), the third path: 0.45 mm (rolling reduction: 31%), the fourth path: 0.30 mm (rolling reduction: 33%), and the fifth path: 0.20 mm (rolling reduction: 33%).

At that time, an optical fiber thermometer was placed at the outlet of the rolling mill and the steel sheet temperature at the outlet roll bite was approximately maintained at the target temperature by continuously measuring the steel sheet temperature and controlling the flow rate of coolants to wiper rolls, work rolls and intermediate rolls.

As a result, the measured value of the steel sheet temperature immediately downstream of the outlet roll bite was controlled within the temperature range of ±2.0° C. (range of variation: 4° C.) with respect to the set value.

Table 1 shows the values of the steel sheet temperature immediately downstream of the outlet roll bite in each rolling path of each coil.

TABLE 1

| Coil | Sheet Temperature (°C.) (measured immediately downstream of the outlet roll bite) | | | | | Magnetic Flux Density | Iron loss |
|---|---|---|---|---|---|---|---|
| Path No. | 1st Path | 2nd Path | 3rd Path | 4th Path | 5th Path | $B_8$ (T) | $W_{17/50}$ (W/kg) |
| 1 | 120 | 180 | 240 | 245 | 130 | 1.968 | 0.703 |
| 2 | 120 | 175 | 235 | 240 | 200 | 1.967 | 0.705 |
| 3 | 125 | 175 | 195 | 135 | 100 | 1.950 | 0.783 |
| 4 | 125 | 215 | 215 | 215 | 135 | 1.952 | 0.764 |
| 5 | 120 | 215 | 185 | 170 | 130 | 1.940 | 0.823 |
| 6 | 125 | 220 | 185 | 175 | 130 | 1.938 | 0.835 |
| 7 | 125 | 173 | 230 | 220 | 85 | 1.965 | 0.712 |
| 8 | 205 | 215 | 225 | 190 | 105 | 1.952 | 0.798 |

Since the coil No. 8 could not obtain the steel sheet temperature of 205° C. in first path by the calorific power resulting from rolling operation alone, the coil was preheated to 130° C. prior to the start of rolling operation.

After the cold rolling was finished, the coils Nos. 1–8 were degreased, subjected to decarbonizing annealing at 850° C. for two minutes in a wet hydrogen atmosphere, coated with MgO containing 5% of $TiO_2$ as an annealing separation agent, wound to a coil shape and then subjected to final finish annealing. In the final finish annealing, the temperature of each coil was increased to 840° C. at a temperature increasing speed of 25° C./hr in an $N_2$ atmosphere and each coil was held in this state for 35 hours. Then, the temperature of each coil was increased up to 1200° C. at 15° C./hr in an atmosphere containing 20% of $N_2$ and 80% of $H_2$. Each coil was then held for 10 hours in an $H_2$ atmosphere as the temperature was decreased.

After the final finish annealing, any unreacted separation agent was removed and each coil was baked with tension application type insulation coating at 800° C. for one minute. This treatment also served as a flattening annealing.

Each of these coils was divided into 20 portions in a longitudinal direction and magnetic characteristic were measured. The averages of the measurements are shown in Table 1.

As shown for coils Nos. 1, 2, 3, 4 and 7, products having excellent magnetic characteristics can be obtained through a temperature pattern in which the rolling temperature is sequentially increased from the first path to the third path.

When the first path has a temperature exceeding 150° C. like in coil No. 8, magnetic characteristics are slightly deteriorated.

From the result of the above experiment, it can be found that the following conditions are effective for achieving excellent magnetic characteristics:

(1) the temperature for each path is not set too high; and (2) the steel sheet temperature immediately downstream of outlet roll bites are increased according to a rolling sequence at least through the third path.

The steel sheet temperature immediately downstream of the first path outlet roll bite must not be set too high because only a small amount of strain exists in the first path such that at high temperatures C of large size precipitates in steel and one is thus unable to produce a rolling texture suitable for obtaining secondary recrystallized grains accumulated largely in the Goss orientation.

Through further experimentation, we discovered a preferred upper limit for first path steel sheet temperature of 150° C. In addition, target steel sheet temperatures are increased for each successive rolling path at least through the third path because the higher thermal activation of denser dislocations resulting from accumulation of working strain enhances the improvement of rolling texture. Reducing the variation in rolling temperature permits a more reliable accumulation of working strain.

The slab component of a grain-oriented silicon steel as an object of the present invention will now be described.

C is necessary in an amount of about 0.02% or more to improve hot rolled structure by making use of γ transformation. On the other hand, when the amount exceeds 0.09%, decarburization is not sufficiently effected. The amount of C is preferably in the range of about 0.02% to about 0.09%.

Si is required in an amount of about 2.5% or more to increase electric resistance and improve iron loss. On the other hand, amounts exceeding about 5.0% cause brittleness and make cold rolling difficult. The amount of Si is preferably in the range of about 2.5% to about 5.0%.

One or more components selected from Al, S and Sb is necessary as an inhibitor component. Although about 0.01% or more of Al is necessary so that it functions effectively as an inhibitor, when Al exceeds about 0.04%, the inhibiting effect is deteriorated. Although about 0.005% or more of S and Se is necessary, when the amount exceeds about 0.03% they are difficult to dissolve with an inhibitor. The amount of S and Se is preferably in the range of about 0.005% to about 0.03%.

Mn is necessary in an amount of about 0.02% or more because it is needed to prevent cracking during hot rolling. MnS, MnSe and the like are also used as inhibitor components, and they are used preferably in amounts ranging from about 0.02% to about 0.3% because when the amount exceeds about 0.3%, they are difficult to dissolve.

Although N is a basic component for precipitating AlN, it is not necessary to set a lower limit because N can be supplied in a nitridation treatment of a cold rolling process. When the amount of N exceeds about 0.011%, however, it is made to gas in a slab heating stage which swells the steel. The amount of N is preferably about 0.011% or less.

In addition to the above, Sb, P, Sn, Bi, As, B, Ge, V, Nb and the like which are conventionally known as an inhibitor reinforcing elements can be added. Further, Mo can be added for the prevention of cracks created during hot rolling, which is a problem specific to silicon steel.

Slabs of silicon steel containing the above components can include slabs made by conventional continuous casting, thin slabs cast by sheet bar casters and the like, and slabs made by re-rolling ingots and the like. The slab of silicon steel is subjected to slab heating by a conventional method and then hot rolled.

A steel sheet having been hot rolled is subjected to hot rolled sheet annealing when necessary and cold rolled to a final thickness once or a plurality of times with intermediate annealing effected therebetween.

The cold rolling method of the present invention is applicable to any of the aforesaid rolling methods and can achieve the desired effect. The method is most effective when it is applied to final rolling.

Further, the invention can be used together with an inter-path aging treatment and well-known cold rolling methods such as low lubrication rolling, rolling with small diameter rolls and the like.

Conditions effective for the cold rolling method of the present invention include a cold rolling path having a temperature within the range of about 150° C. to about 350° C. When rolling is effected through a plurality of paths, at least one of the paths must satisfy the above temperature condition. When the rolling temperature is less than 150° C. in all the paths, the texture cannot be changed. Conversely, texture is deteriorated when all the paths have a temperature exceeding 350° C., and rolling becomes unstable because the rolling oil is largely evaporated.

It is important to maintain the rolling temperature in the rolling paths in a range of about 150° C. to about 350° C. so as to limit the fluctuation in magnetic characteristics.

Rolling temperature is estimated best by measuring steel sheet temperature immediately downstream of an outlet roll bite immediately after rolling. The rolling operation temperature is affected by the steel sheet temperature on the inlet side of a rolling mill, the surface temperature of work rolls in contact with the steel sheet and an increase of temperature caused by heat resulting from the rolling operation. The steel sheet temperature immediately downstream of outlet roll bite is also affected by strip coolants encountered before an inlet roll bite. However, it is the amount of heat extracted from the surface of work rolls that most affects rolling temperature when rolling reduction and rolling speed are given. Therefore, it is most important to control the amount of coolant or coolants applied to work rolls so as to limit the fluctuation in rolling temperature as well as the fluctuation of steel sheet temperature immediately downstream of an outlet roll bite immediately after rolling.

Rolling conditions variables other than steel sheet temperature immediately downstream of the outlet roll bite may be used to estimate the amount of a coolant that should be applied to control sheet temperature. However, the most effective method for controlling the steel sheet temperature in the outlet roll bite on the outlet side of a rolling mill is to control the amount of a coolant based on the measured value of the steel sheet temperature immediately downstream of the outlet roll bite.

The steel sheet temperature in the roll bite on the outlet side of the rolling mill is preferably within a range of about 15° C. and most preferably within a range of about 7° C. to both minimize the variation in magnetic characteristics and improve their values.

The target temperature range of a cold rolling path for limiting the variation of a steel sheet temperature is about 150° C.–350° C., and when a plurality of paths are used, they all must satisfy the above temperature condition.

When the temperature in the first rolling path is set to about 150° C. or less and the target values of the steel sheet temperature at the outlet side of rolling are increased for each subsequent rolling path up to at least the third path and the steel sheet temperature in the roll bites on the outlet side of rolling are controlled within a small range, rolling deformation modes are changed according to the accumulation of working strain, thus improving rolling texture and magnetic characteristics of the steel.

The amount of coolant applied to the work rolls can be also controlled by controlling the amount of coolant applied to other rolls constituting the cold rolling mill. These other rolls are represented by backup rolls, bearing rolls, intermediate rolls and wiper rolls in a Sendzimir type cold rolling mill, and by backup rolls and intermediate rolls in a tandem type cold rolling mill.

Although these non-work rolls are cooled and cleaned by coolants at all times, the coolant of each roll not only stays on the respective roll but also flows down or is rolled in by the rotation of the rolls and reaches the surface of work rolls, thus cooling them. Therefore, the same effect as that obtained when the flow rate of a coolant to the work rolls is controlled can be obtained by controlling the flow rate of a coolant to any roll in a cold rolling mill.

The other method of decreasing the variation of steel sheet temperature immediately downstream of an outlet roll bite is controlling of strip coolant or strip coolants before inlet roll bites.

Figure 4:
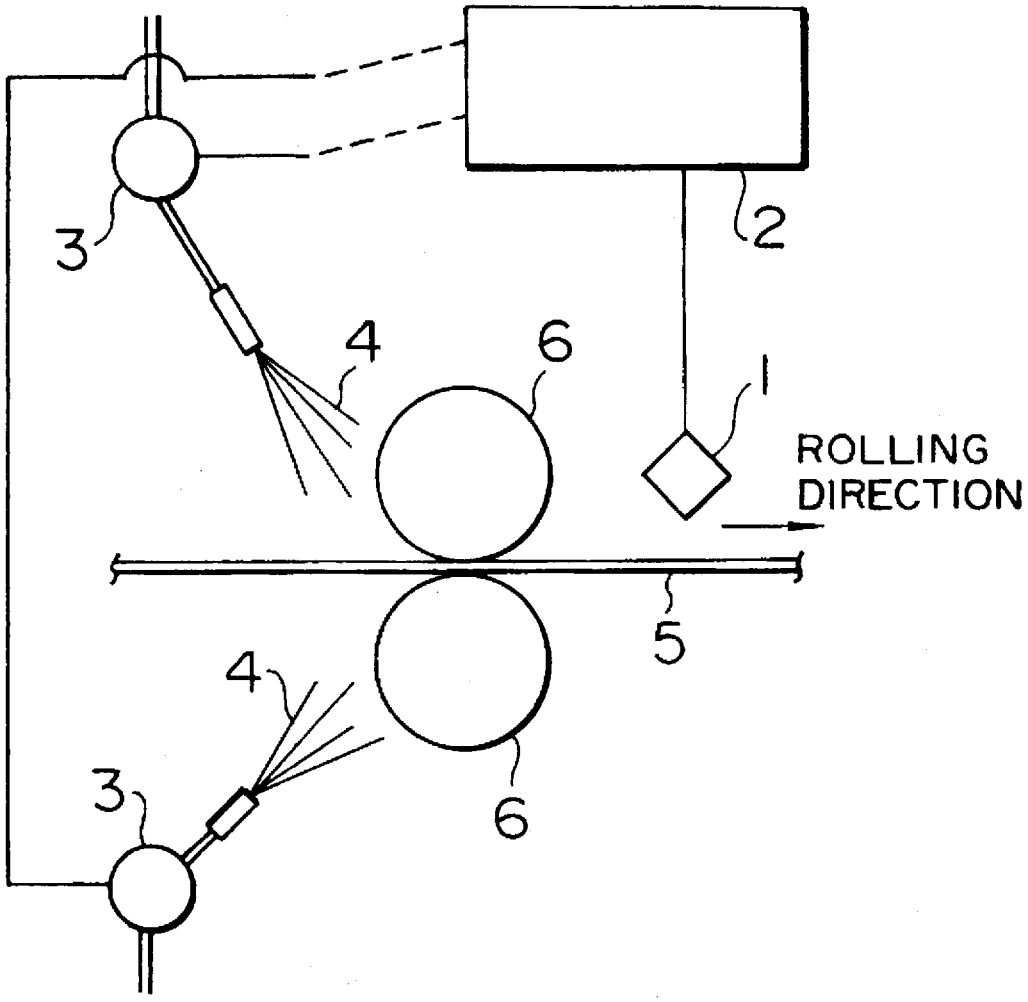
FIG. 4 is a schematic diagram of an example of a cooling controller of the present invention.

As shown in FIG. 4, an apparatus for realizing the aforesaid cold rolling method is arranged such that a conventional cold rolling mill is provided with a temperature measuring sensor 1 installed immediately downstream of an outlet roll bite to measure the temperature of a steel sheet 5 coming from the roll bite. A temperature controller 2 transmits a feedback signal based on a signal transmitted by the temperature measuring sensor 1 so that the measured signal is compared to a target value and flow rate controller 3 controls the flow rate of roll coolant or strip coolant 4 based on the signal produced by the temperature controller 2. Numeral 6 denotes work rolls.

Although FIG. 4 shows an apparatus for controlling the flow rate of coolant 4 to work rolls 6, a similar apparatus may be used to control the flow rate of coolants to intermediate rolls, backup rolls, bearing rolls, and wiper rolls.

Temperature measuring sensor 1 is used to measure steel sheet temperature, and in general a contact type thermometer or a radiation thermometer are used. The sensor is installed at a position where it can measure the temperature of steel sheet coming from a roll bite on the upper surface, lower surface or both surfaces.

Temperature control unit 2 may comprise a temperature control unit used to control temperature in various heat treatment processes. Further, any electric type, magnetic type or mechanical type flow rate controller may be effectively used as a coolant flow rate controller 3.

A steel sheet having been finally cold rolled is generally subjected to decarbonizing annealing or to primary recrystallization annealing. The decarbonizing annealing is effected at about 750° C.–900° C. for about 60–180 seconds in a wet hydrogen atmosphere.

Thereafter, the steel sheet is subjected to a secondary recrystallization annealing in a continuous annealing process or coated with an annealing separation agent. The sheet is then wound to a coil shape and subjected to final finish annealing.

After the final finish annealing, an insulation coating is applied when it is necessary to increase the insulation resistance of the sheet.

Figure 5A:
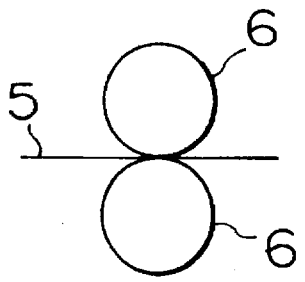
FIGS. 5A–5E are schematic diagrams of examples of cold rolling mills to which the present invention may inhere.
Figure 5B:
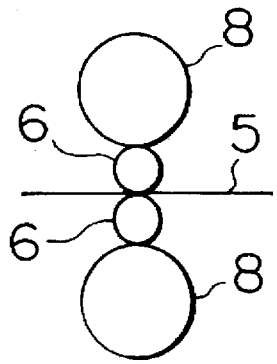
Figure 5C:
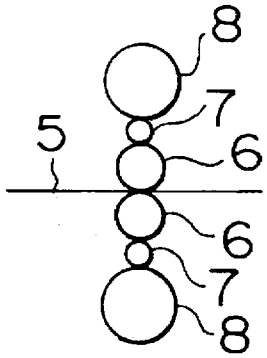
Figure 5D:
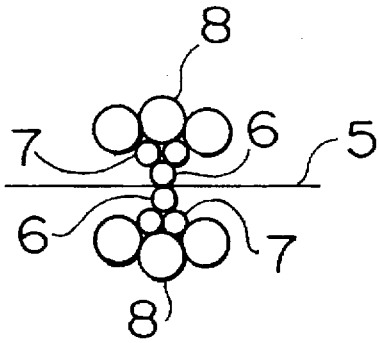
Figure 5E:
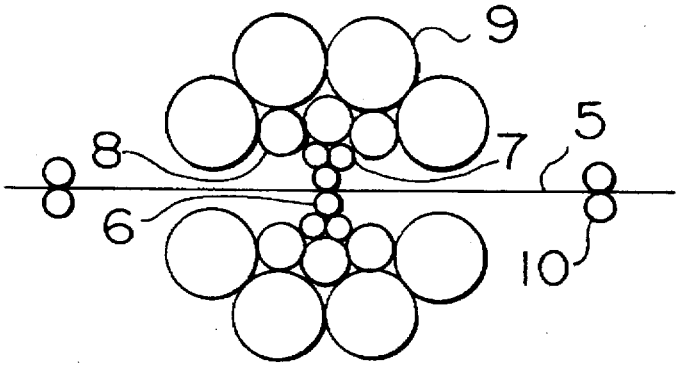

Any of the well-known cold rolling mills can be used as the cold rolling mill of the present invention, including, for example, a rolling mill composed of only a pair of work rolls (2Hi type) as shown in FIG. 5A, a rolling mill provided with a pair of backup rolls (4Hi type) as shown in FIG. 5B, a rolling mill provided with intermediate rolls (6Hi type) as shown in FIG. 5C, a planetary type rolling mill having a plurality of pairs of backup rolls as shown in FIG. 5D, and a Sendzimir type rolling mill as shown in FIG. 5E. With respect to roll stands, anything from a reverse type single stand to a tandem type stand for performing rolling operation in one direction are applicable. Reverse type stands, however, require that the temperature sensors be installed on the inlet side and outlet side.

Embodiments of the present invention will hereinafter be described in detail with reference to specific forms of the invention, but specific terms used in the specification are not intended to limit the scope of the invention which is defined in the appended claims.

EXAMPLE 1

A slab denoted by Slab No. A in Table 2 was heated at 1420° C. for 15 minutes and rolled to a hot rolled sheet 1.8 mm thick by a conventional method. The hot rolled sheet was subjected to hot rolled annealing at 1130° C. for 60 seconds, pickled and then cold rolled to a thickness of 0.30 mm by a Sendzimir rolling mill having a work roll diameter of 120 mmϕ.

A rolling path schedule was set to 1.35 mm (rolling reduction: 25%) for the first path, 0.95 mm (rolling reduction: 30%) for the second path, 0.65 mm (rolling reduction: 32%) for the third path, 0.45 mm (rolling reduction: 31%) for the fourth path and 0.30 mm (rolling reduction: 33%) for the fifth path, and the coil was finished to a thickness of 0.30 mm. The sheet was divided into two portions (E) and (F).

The cooling controller shown in FIG. 4 of the present invention was used on the coil (E). That is, the roll cooling controller was used to control the application of coolants to work rolls, intermediate rolls and bearing rolls. However, the flow rate of coolant to the wiper rolls was held constant.

The target temperature to be measured immediately downstream of the outlet roll bite of each path was set to 155° C. for the first path, 185° C. for the second path, 201° C. for the third path, 215° C. for the fourth path and 95° C. for the fifth path.

The variation of the steel sheet temperature along the rolling direction of the sheet immediately downstream of outlet roll bite was 1° C. in the first path, 3° C. in the second path, 3° C. in the third path, 4° C. in the fourth path and 3° C. in the fifth path.

The steel sheet was wound to a coil shape at high temperature after the rolling operation. During the rolling operation the rolling speed was gradually increased from 50 mpm to 500 mpm until the speed reached the maximum speed of 500 mpm, upon which it was gradually reduced to 50 mpm whereupon the rolling operation was terminated.

Portion (F) of the divided coil was treated as a comparative example such that an optical fiber radiation thermometer was installed at the inlet of the rolling mill to continuously measure the steel sheet temperature. A temperature controller then transmitted a feedback signal to a coolant flow meter so that the measured temperature was coincided with the target temperature.

The flow rate of coolant to the wiper rolls was automatically adjusted by a flow rate controller and the flow rate of coolants to the other work rolls, intermediate rolls and bearing rolls was held constant. At that time, the temperature target at the inlet of the rolling mill in each path was set to 25° C. for the first path, 146° C. for the second path, 185° C. for the third path, 205° C. for the fourth path and 195° C. for the fifth path.

The variation in steel sheet temperature along the rolling direction of the coil immediately downstream of the outlet roll bites was 4° C. in the first path, 6° C. in the second path, 6° C. in the third path, 7° C. in the fourth path and 3° C. in the fifth path.

The steel sheet was wound to a coil shape at high temperature after the rolling operations. During the rolling operation the rolling speed was gradually increased from 50 mpm to a maximum speed of 500 mpm, whereupon it was gradually reduced to 50 mpm whereupon the rolling operation was terminated.

The two coils were degreased, subjected to decarbonizing annealing at 850° C. for two minutes in a wet hydrogen atmosphere, coated with MgO containing 1% of Sr(OH)

$_2$·8$H_2O$ and 5% of $TiO_2$ as an annealing separation agent, wound to a coil shape, and then subjected to final finish annealing. During the final finish annealing, the coils were held at 840° C. for 25 hours in an $N_2$ atmosphere, then the temperature was increased up to 1200° C. at a speed of 15° C./hr, wherein the coils were held in an atmosphere containing 25% of $N_2$ and 75% of $H_2$ up to 1150° C. and held in an $H_2$ atmosphere from 1150° C. to 1200° C. and for 10 additional hours at 1200° C.

After the final finish annealing, any unreacted separation agent was removed and the coils were baked with tension application type insulation coating at 800° C. for one minute. This treatment also served as a flattening annealing. Each coil was then divided into 20 portions. Table 3 shows the average values and standard deviations of the measured magnetic characteristics, average sheet thicknesses (ta) and differences of sheet thickness in a sheet width direction (Δt: value obtained by subtracting the sheet thickness at the coil central portion from the sheet thickness at a position 100 mm in from the coil edge).

As shown in Table 3, coil (E), which had the steel sheet temperature at rolling outlet of each rolling path was controlled within a small range was superior in both magnetic characteristics and sheet steel configuration.

TABLE 2

| Ingot | Composition (%) | | | | | | | |
|---|---|---|---|---|---|---|---|---|
| Symbol | C | Si | Mn | P | Al | Se | Sb | N |
| A | 0.078 | 3.22 | 0.07 | 0.010 | 0.025 | 0.018 | 0.025 | 0.007 |
| B | 0.038 | 3.15 | 0.07 | 0.008 | 0.001 | 0.019 | 0.025 | 0.003 |
| C | 0.075 | 3.25 | 0.07 | 0.005 | 0.023 | 0.018 | 0.024 | 0.008 |

TABLE 3

| Coil | E | | F | |
|---|---|---|---|---|
| Classification of Numericals | Averaged Value | Standard Deviation | Average Value | Standard Deviation |
| $B_8$ (T) | 1.9327 | 0.00468 | 1.9266 | 0.00986 |
| $W_{17/50}$ (W/kg) | 1.004 | 0.0196 | 1.0495 | 0.0511 |
| ta (mm) | 0.3101 | 0.00193 | 0.3081 | 0.00807 |
| Δt (μm) | 4.55 | 1.985 | 9.40 | 4.271 |
| Reference | Example | | Comparative Example | |

EXAMPLE 2

A slab denoted by Slab No. B in Table 2 was heated at 1400° C. for 30 minutes and rolled to hot rolled sheets 1.9 mm thick for coils (G), (H), (I) and (J) by a conventional method. Each hot rolled sheet was subjected to hot rolled steel annealing at 1000° C. for 60 seconds, pickled and then subjected to first cold rolling to produce a thickness of 0.62 mm by a 4-stand tandem rolling mill.

A rolling path schedule was set to 1.40 mm (rolling reduction: 26%) for the first path, 1.05 mm (rolling reduction: 25%) for the second path, 0.80 mm (rolling reduction: 24%) for the third path, and 0.62 mm (rolling reduction: 23%) for the fourth path.

The roll cooling controller of the present invention was used on the coils (G) and (H). That is, the cooling controller shown in FIG. 4 was used to apply coolants to work rolls, intermediate rolls and bearing rolls. However, the flow rate of coolant to the wiper rolls was held constant.

Target temperatures for the outlets of the rolling paths were set to 95° C. for the first path, 97° C. for the second path, 165° C. for the third path and 176° C. for the fourth path. The sheets for coils (G) and (H) were wound to a coil shape at high temperatures.

The variation in the steel sheet temperature along the rolling direction of the coil immediately downstream of the outlet roll bite was 4° C. in the first path, 5° C. in the second path, 6° C. in the third path and 7° C. in the fourth path.

The steel for coils (I) and (J) was rolled to a thickness of 0.62 mm with the flow rate of coolants held constant and the rolled steel sheet was wound to a coil shape at high temperatures.

The temperature at the outlet of rolling in each path ranged from 65° to 107° C. in the first path, from 65° to 115° C. in the second path, from 154° to 176° C. in the third path and from 172° to 194° C. in the fourth path.

Next, the four coils (G), (H), (I) and (J) were degreased and subjected to intermediate annealing at 1050° C. for 40 seconds and then to second cold rolling to produce a final thickness of 0.22 mm by a 4-stand tandem rolling mill similar to the above rolling mill.

A rolling path schedule was set to 0.49 mm (rolling reduction: 21%) for the first path, 0.38 mm (rolling reduction: 22%) for the second path, 0.30 mm (rolling reduction: 21%) for the third path, and 0.22 mm (rolling reduction: 27%) for the fourth path.

The roll cooling controller of the present invention was used on the coils (G) and (I). The cooling controller shown in FIG. 4 was used to control application of coolants to work rolls, intermediate rolls and backup rolls. However, the coolant flow rate to the wiper rolls was held constant.

The temperature target at the outlet of rolling was set to 85° C. for the first path, 93° C. for the second path, 152° C. for the third path and 172° C. for the fourth path.

Variation in the steel sheet temperature along the rolling direction of the coil immediately downstream of the outlet roll bite was 4° C. in the first path, 4° C. in the second path, 6° C. in the third path and 6° C. in the fourth path. After rolling, the steel sheets were would to a coil shape at high temperature.

The remaining two coils (H) and (J) were rolled to a thickness of 0.22 mm with the flow rate of each coolant held constant. The temperature at the outlet of rolling varied from 64° C. to 92° C. in the first path, from 60° C. to 103° C. in the second path, from 142° C. to 198° C. in the third path and from 165° C. to 213° C. in the fourth path. After rolling, the steel sheets were wound to a coil shape at high temperature.

The rolled coils were degreased, subjected to decarburizing annealing at 820° C. for two minutes in a wet hydrogen atmosphere, coated with MgO containing 1% of $SrSO_4$ and 7% of $TiO_2$ as an annealing separation agent, wound to a coil shape, and then subjected to final finish annealing. The final finish annealing was carried out such that the coils were held at 850° C. for 50 hours in an $N_2$ atmosphere, then the temperature was increased up to 1200° C. in an atmosphere containing 75% of $H_2$ and 25% of $N_2$, and finally the coils were held at 1200° C. for five hours in an $H_2$ atmosphere.

After the final finish annealing, any unreacted separation agent was removed and the coils were baked with tension application type insulation coating at 820° C. for one minute. This treatment also served as a flattening annealing.

Each of the coils was divided into 20 portions and the magnetic characteristics, average thicknesses (ta) and differences of thickness in a sheet width direction (Δt: value obtained by subtracting the sheet thickness at the coil central portion from the sheet thickness at the position 100 mm in from the coil edge) were measured. Table 4 shows the average values and standard deviations.

TABLE 4

| Coil | G | | H | | I | | J | |
|---|---|---|---|---|---|---|---|---|
| Classification of Numericals | Average Value | Standard Deviation | Average Value | Standard Deviation | Average Value | Standard Deviation | Average Value | Standard Deviation |
| $B_8$ (T) | 1.9069 | 0.00202 | 1.9050 | 0.00368 | 1.9065 | 0.00226 | 1.9011 | 0.00648 |
| $W_{17/50}$ (W/kg) | 0.860 | 0.01640 | 0.883 | 0.02492 | 0.8685 | 0.02006 | 0.8935 | 0.03004 |
| 1a (mm) | 0.2298 | 0.00096 | 0.2296 | 0.00131 | 0.2296 | 0.00111 | 0.2298 | 0.00160 |
| Δt (μm) | 5.60 | 1.959 | 7.70 | 2.571 | 6.85 | 1.590 | 12.00 | 2.645 |
| Reference | Example | | Example | | Example | | Comparative Example | |

As shown in Table 4, the coils (G), (H) and (I) which employed the cold rolling of the present invention at least once in the two rolling operations exhibit excellent magnetic characteristics and sheet steel configuration. Coil (G), which employed the cold rolling of the present invention in both first and second cold rolling operations, exhibited particularly excellent results.

EXAMPLE 3

Two slabs denoted by Slab No. C in Table 2 were heated at 1410° C. for 20 minutes and rolled to hot rolled sheet 2.2 mm thick by a conventional method. The hot rolled sheets were pickled in acid and then rolled to a thickness of 1.50 mm by a tandem rolling mill.

Thereafter, the rolled sheets were subjected to intermediate annealing by being soaked at 1100° C. for 90 seconds, cooled to 350° C. at a cooling speed of 45° C./sec with mist water and successively cooled gradually to a room temperature at a cooling speed of 20° C./sec for 130 seconds. Thereafter, the sheets were rolled to a final thickness of 0.22 mm by a Sendzimir rolling mill.

A rolling path schedule for the sheets rolled by the Sendzimir rolling mill was set to 1.00 mm (rolling reduction: 33%) for the first path, 0.75 mm (rolling reduction: 25%) for the second path, 0.55 mm (rolling reduction: 26%) for the third path, 0.40 mm (rolling reduction: 27%) for the fourth path, 0.30 mm (rolling reduction: 25%) for the fifth path and 0.22 mm (rolling reduction: 27%) for the sixth path.

The roll cooling controller of the present invention was used in the rolling operation effected by the Sendzimir rolling mill.

The cooling controller shown in FIG. 4 was used to control the application of coolants to work rolls, intermediate rolls and bearing rolls. However, the flow rate of coolant to the wiper rolls was held constant.

In the rolling operation effected by the Sendzimir rolling mill, the temperatures of the steel sheet immediately downstream of the outlet roll bites of two rolls were set to different values for each sheet.

The steel sheet temperature of the first sheet immediately downstream of the outlet roll bite of each path was set to 153° C. for the first path, 185° C. for the second path, 207° C. for the third path, 226° C. for the fourth path, 192° C. for the fifth path and 124° C. for the sixth path.

After rolling, the sheet was wound to a coil shape at high temperature.

Variation in the steel sheet temperature along the rolling direction of the coil measured immediately downstream of outlet roll bite was 3° C. in the first path, 3° C. in the second path, 2° C. in the third path and 4° C. in the fourth to sixth paths, respectively.

The steel sheet temperature of the second sheet immediately downstream of the outlet roll bite of each path was set to 135° C. for the first path, 160° C. for the second path, 175° C. for the third path, 180° C. for the fourth path, 175° C. for the fifth path and 140° C. for the sixth path.

After rolling, the sheet was wound to a coil shape at high temperature.

Variation in the steel sheet temperature measured immediately downstream of the outlet roll bite was 3° C. in the first path, 3° C. in the second path, 2° C. in the third path and 4° C. in the fourth to sixth paths, respectively.

After the completion of the cold rolling operation, the first and second coils were degreased, subjected to decarbonizing and annealing at 840° C. for two minutes in a wet hydrogen atmosphere, coated with MgO containing 1% of $SrSO_4$ and 5% of $TiO_2$ as an annealing separation agent, wound to a coil shape, and then subjected to final finish annealing. The final finish annealing was carried out in such a manner that the coils were held at 840° C. for 20 hours in an $N_2$ atmosphere, the temperature then was increased up to 1200° C. at a speed of 15° C./hr, wherein the coils were held in an atmosphere containing 25% of $N_2$ and 75% of $H_2$ up to 1150° C. and held in an $H_2$ atmosphere from 1150° C. to 1200° C. and for 10 additional hours at 1200° C.

After the final finish annealing, any unreacted separation agent was removed and the coils were baked with tension application type insulation coating at 800° C. for one minute. This treatment also served as a flattening annealing.

Thereafter, each of the first and second coils was divided into 20 portions and the average values and standard deviations of the measured magnetic characteristics, average thicknesses (ta) and differences of thickness in a sheet width direction (Δt) of the coils were calculated.

Table 5 shows the result.

TABLE 5

| Coil | 1st Coil | | 2nd Coil | |
|---|---|---|---|---|
| Classification of Numericals | Average value | Standard Deviation | Average Value | Standard Deviation |
| $B_8$ (T) | 1.9383 | 0.00266 | 1.9425 | 0.00254 |
| $W_{17/50}$ (W/kg) | 0.8275 | 0.01639 | 0.8015 | 0.001523 |
| ta (mm) | 0.2298 | 0.00085 | 0.2274 | 0.00076 |
| Δt (μm) | 5.10 | 1.609 | 5.06 | 1.413 |
| Reference | Example of Present Invention | | Example of Present Invention | |

Table 5 shows that the first and second coils of example 3 exhibit remarkably uniform and excellent magnetic characteristics. Further, only minor fluctuations were found in the thickness of the steel sheets.

EXAMPLE 4

Eight pieces of slab each composed of C: 0.081%, Si: 3.35%, Mn:0.07%, P:0.005%, Al: 0.025%, S:0.014%, Sb: 0.025%, Ni: 0.007% and the balance iron with associated impurities were heated at 1410° C. for 15 minutes and then rolled to hot rolled sheets 2.0 mm thick by a conventional method.

The respective hot rolled sheets (K)–(R) were subjected to hot rolled sheet annealing comprising annealing at 1150° C.

for 50 seconds and cooling with mist water at an average cooling speed of 45° C./sec, pickling and then rolling to a final thickness of 0.27 mm by a Sendzimir rolling mill.

A rolling path schedule for each of the eight sheets was set to 1.40 mm (rolling reduction: 30%) for the first path, 1.00 mm (rolling reduction: 29%) for the second path, 0.70 mm (rolling reduction: 30%) for the third path, 0.40 mm (rolling reduction: 43%) for the fourth path and 0.27 mm (rolling reduction: 33%). for the fifth path.

The steel sheet temperature immediately downstream of the outlet roll bite for each of the four coils (K)–(N) was controlled by controlling the flow rate of coolants according to the present invention.

The steel sheet temperature immediately downstream of outlet roll bite for each of the four coils (K)–(N) was set to 95° C. for the first path, 125° C. for the second path, 180° C. for the third path, 135° C. for the fourth path and 110° C. in the fifth path.

Table 6 shows the variation in steel sheet temperature along the rolling direction of the coil immediately downstream of the outlet roll bite.

The steel sheet temperature immediately downstream of the outlet roll bite of the third path of the coils (K)–(N) was 180° C. The temperature variation of coil (N) was beyond the value of the present invention, while those of the coils (K)–(L) were within the value.

Coil (O) had a target steel sheet temperature immediately downstream of the outlet roll bites that was controlled by changing the rolling speed.

The steel sheet temperature target for the coil (O) immediately downstream of the outlet roll bites was 95° C. in the first path, 125° C. in the second path, 180° C. in the third path, 135° C. in the fourth path and 110° C. in the fifth path.

Table 6 shows the variation of steel sheet temperature along the rolling direction of the coil immediately downstream of the outlet roll bite. The temperature variation for coil (O) was 4° C.–6° C.

Coil (P), as a comparative example, had a target steel sheet temperature set at the inlet of the rolling mill. The steel sheet temperature for coil (P) at the inlet of the rolling mill was maintained at the target temperature by controlling the flow rate of coolants to the wiper rolls and work rolls on the inlet side of the rolling mill.

The steel sheet temperature of coil (P) at the inlet of the rolling mill was set to 95° C. for the first path, 125° C. for the second path, 180° C. for the third path, 135° C. for the fourth path and 110° C. in the fifth path.

Table 6 shows the variation of the steel sheet temperature along the rolling direction of the coil immediately downstream of outlet roll bite for coil (P).

For coil (Q) (a comparative example), the flow rate of the respective coolants of the rolling mill held constant.

Table 6 shows the variation of the steel sheet temperature along the rolling direction of the coil immediately downstream of the outlet roll bite for coil (Q). Coil (R) (a comparative example) had a target steel sheet temperature set at the inlet of the rolling mill which was maintained by controlling the flow rate of a strip coolant.

Coil (R) had the following target steel sheet temperature set at the inlets of the rolling mills: the first path was set to 95° C., the second path was set to 125° C., the third path was set to 180° C., the fourth path was set to 135° C. and the fifth path was set to 110° C. as a set temperature.

Table 6 shows the variation of the steel sheet temperature along the rolling direction of the coil immediately downstream of the outlet roll bite for coil (R).

After the completion of the cold roll operation, each coil was degreased, then subjected to decarburizing annealing at 840° C. for two minutes in a wet hydrogen atmosphere. Next, each coil was coated with MgO containing 1% of $Sr(OH)_2.8H_2O$ and 8% of $TiO_2$ as an annealing separation agent, wound to a coil shape, and then subjected to final finish annealing.

The final finish annealing was carried out such that each coil was heated up to 1200° C. at a speed of 15° C./hr in an atmosphere containing 25% of $N_2$ and 75% of $H_2$, then held at 1200° C. for 10 hours in an $H_2$ atmosphere.

After the final finish annealing, any unreacted separation agent was removed and each coil was baked with tension application type insulation coating at 800° C. for one minute. This treatment also served as a flattening annealing.

Thereafter, each coil was divided into 20 portions and magnetic characteristics were measured.

Table 6 shows the temperature variation along the rolling direction of the steel sheet immediately downstream of the outlet roll bite of the third path and the average values and standard deviations of iron loss (W17/50) (W/kg) of each coil.

Table 6 reveals that smaller temperature variations immediately downstream of outlet roll bites improves iron loss values and their uniformity.

TABLE 6

| Path | Target Temperature (°C.) | Temperature Variation (°C.) K | L | M | N | O | P | Q | R |
|---|---|---|---|---|---|---|---|---|---|
| 1st Path | 95 | 1 | 4 | 12 | 17 | 5 | 19 | 33 | 16 |
| 2nd Path | 125 | 1 | 5 | 8 | 21 | 6 | 20 | 25 | 18 |
| 3rd Path | 180 | 2 | 6 | 13 | 17 | 5 | 18 | 32 | 20 |
| 4th Path | 135 | 1 | 4 | 13 | 17 | 7 | 21 | 28 | 19 |
| 5th Path | 110 | 1 | 3 | 15 | 18 | 4 | 22 | 42 | 18 |
| Average Iron Loss $W_{17/50}$ (W/kg) | | 0.860 | 0.860 | 0.870 | 0.890 | 0.860 | 0.910 | 0.95 | 0.915 |
| Iron Loss Standard Deviation $W_{17/50}$ (W/kg) | | 0.018 | 0.018 | 0.022 | 0.025 | 0.018 | 0.29 | 0.043 | 0.027 |
| Reference | | Examples of Present Invention | | | *1 | *2 | Comparative Examples | | |

*1 means Comparative Example.
*2 means Example of Present Invention

EXAMPLE 5

Eight pieces of slab each composed of C: 0.065%, Si: 3.35%, Mn:0.07%, P:0.005%, Al: 0.026%, S:0.003%, Sb:

0.035%, Ni: 0.007% and the balance iron with associated impurities were heated at 1350° C. for 30 minutes and then rolled to hot rolled sheets 2.2 mm thick by a conventional method.

The respective hot rolled sheets (S)–(Z) were subjected to hot rolled sheet annealing comprising annealing at 1150° C. for 40 seconds and cooling with mist water at an average cooling speed of 50° C./sec, pickling and then rolling to a final thickness of 0.35 mm by a Sendzimir rolling mill.

A rolling path schedule for each of the eight sheets was set to 1.60 mm (rolling reduction: 27%) for the first path, 1.10 mm (rolling reduction: 31%) for the second path, 0.80 mm (rolling reduction: 27%) for the third path, 0.55 mm (rolling reduction: 31%) for the fourth path and 0.35 mm (rolling reduction: 36%) for the fifth path.

The steel sheet temperature of the eight sheets immediately downstream of outlet roll bites was maintained by controlling the flow rate of coolants according to the present invention.

The coolant flow rate was controlled for coolants applied to strip wiper rolls, work rolls, backup rolls, bearing rolls, and intermediate rolls.

Table 7 shows the steel sheet temperature immediately downstream of the outlet roll bite of each rolling path for each sheet in the rolling operation.

The variation of the steel sheet temperature immediately downstream of the outlet roll bite in the rolling operation was controlled within the range of ±2.5° C.

Since the steel for coil (Z) could not achieve a steel sheet temperature of 185° C. in the first path through the calorific power resulting from the rolling operation alone, the steel for coil (Z) was preheated to 100° C. prior to the start of rolling operation.

After completing the cold roll operation, each sheet was degreased and subjected to decarbonizing annealing at 840° C. for two minutes in a wet hydrogen atmosphere. Next, each sheet was coated with MgO containing 10% of $TiO_2$ as an annealing separation agent, wound to a coil shape, and then subjected to final finish annealing.

The final finish annealing was carried out such that each coil was heated up to 840° C. at a speed of 25° C./hr in an $N_2$ atmosphere, held in an $H_2$ atmosphere for 40 hours, heated up to 1200° C. at a heating speed of 15° C./hr in an atmosphere containing 25% of $N_2$ and 75% of $H_2$, and then held for 10 hours in an $H_2$ atmosphere.

After final finish annealing, any unreacted separation agent was removed and each coil was baked with tension application type insulation coating at 800° C. for one minute. This treatment also served as a flattening annealing.

Each coil was divided into 20 portions and averages for the magnetic characteristics measured were calculated.

Table 7 shows these values.

As shown in Table 7, coils (S), (T), (U), (Y) and (Z) exhibit excellent magnetic characteristics and were obtained by employing a temperature pattern in which the rolling temperature was sequentially increased from the first path to the third path.

TABLE 7

| | Set Temperature (°C.) | | | | | | | |
|---|---|---|---|---|---|---|---|---|
| Path | S | T | U | V | W | Z | Y | Z |
| 1st Path | 125 | 120 | 125 | 130 | 120 | 125 | 120 | 185 |
| 2nd Path | 175 | 170 | 175 | 225 | 225 | 225 | 165 | 200 |
| 3rd Path | 230 | 220 | 185 | 225 | 195 | 170 | 220 | 235 |
| 4th Path | 245 | 240 | 130 | 225 | 180 | 160 | 220 | 195 |
| 5th Path | 140 | 245 | 105 | 140 | 140 | 140 | 90 | 100 |
| Average Magnetic Flux Density $B_8$ (T) | 1.945 | 1.944 | 1.943 | 1.932 | 1.930 | 1.921 | 1.945 | 1.944 |
| Average Iron Loss $W_{17/50}$ (W/kg) | 1.043 | 1.045 | 1.057 | 1.075 | 1.108 | 1.193 | 1.047 | 1.095 |

A grain-oriented silicon steel sheet having excellent and uniform magnetic characteristics along the rolling direction of a coil made in accordance with the present invention has great industrial value.

Although this invention has been described with reference to specific forms of apparatus and method steps, equivalent steps may be substituted, the sequence of steps may be varied, and certain steps may be used independently of others. Further, various other control steps may be included, all without departing from the spirit and scope of the invention, which is defined in the appended claims.

What is claimed is:

1. A method of cold rolling grain-oriented silicon steel sheet having excellent and uniform magnetic characteristics along the rolling direction of a coil, said cold rolling being performed prior to a primary and a secondary recrystallization, comprising controlling the temperature of a steel sheet along said rolling direction of said coil immediately downstream of the outlet roll bites of one or more rolling paths to a range of about 15° C. or less, and controlling the temperature of one or more of said rolling paths between about 150° C. to about 350° C.

2. A method of cold rolling grain-oriented silicon steel sheet having excellent and uniform magnetic characteristics along the rolling direction of a coil, said cold rolling being performed prior to a primary and a secondary recrystallization, comprising controlling the temperature of a steel sheet along said rolling direction of said coil immediately downstream of the outlet roll bites of one or more rolling paths to a range of about 7° C. or less, and controlling the temperature of one or more of said rolling paths to between about 150° C. to about 350° C.

3. A method of cold rolling grain-oriented silicon steel sheet having excellent and uniform magnetic characteristics along the rolling direction of a coil, said cold rolling being performed prior to a primary and a secondary recrystallization, comprising controlling the temperature of a steel sheet along said rolling direction of said coil immediately downstream of the outlet roll bites of one or more rolling paths to a range of about 15° C. or less by controlling the flow rate of coolants in said rolling path and controlling the temperature of one or more of said rolling paths between about 150° C. to about 350° C.

4. A method of cold rolling grain-oriented silicon steel sheet having excellent and uniform magnetic characteristics along the rolling direction of a coil, said cold rolling being performed prior to a primary and a secondary recrystallization, comprising controlling the temperature of a steel sheet along said rolling direction of said coil immediately downstream of the outlet roll bites of one or more rolling paths by measuring a steel sheet temperature immediately downstream of the outlet roll bites of said rolling paths and controlling the flow rate of a coolant to one or more rolls of the rolls constituting a cold rolling mill based on said measured steel sheet temperature so that the steel sheet temperature immediately downstream of the outlet roll bites of the rolling paths is controlled to a range of about 15° C. or less, and controlling the temperature of one or more of said rolling paths between about 150° C. to about 350° C.

5. A method of cold rolling grain-oriented silicon steel sheet having excellent and uniform magnetic characteristics along the rolling direction of a coil, said cold rolling being performed prior to a primary and a secondary recrystallization, comprising controlling the temperature of a steel sheet along said rolling direction of said coil immediately downstream of the outlet roll bites of one or more rolling paths to a range of about 7° C. or less by controlling the flow rate of coolants in said rolling path and controlling the temperature of one or more of said rolling paths between about 150° C. to about 350° C.

6. A method of cold rolling grain-oriented silicon steel sheet having excellent and uniform magnetic characteristics along the rolling direction of a coil, said cold rolling being performed prior to a primary and a secondary recrystallization, comprising controlling the temperature of a steel sheet along said rolling direction of said coil immediately downstream of the outlet roll bites of one or more rolling paths by measuring a steel sheet temperature immediately downstream of the outlet roll bites of said rolling paths and controlling the flow rate of a coolant to one or more rolls of the rolls constituting a cold rolling mill based on said measured steel sheet temperature so that the steel sheet temperature immediately downstream of the outlet roll bites of the rolling paths is controlled to a range of about 7° C. or less, and controlling the temperature of one or more of said rolling paths between about 150° C. to about 350° C.

7. A method according to any one of claims 1 to 6, wherein the temperature of a first rolling path immediately downstream of the outlet roll bites is controlled to about 150° C. or less and temperatures measured immediately downstream of subsequent outlet roll bites are sequentially increased to at least a third path.

8. A cooling controller for cold rolling a grain-oriented silicon steel sheet having excellent and uniform magnetic characteristics along the rolling direction of a coil prior to primary and secondary recrystallization, comprising:

a sensor for measuring the temperature on the upper surface or lower surface or both surfaces of said silicon steel sheet immediately downstream of the outlet roll bites of at least one rolling path;

a monitor for producing a feedback signal so that a signal measured by said sensor is made to coincide with a target value; and a controller for maintaining the temperature fluctuation of said silicon steel sheet immediately downstream of the outlet roll bites within a range of about 15° C. or less and the temperature along said at least one rolling path between about 150° C. and 350° C. by controlling the flow rate of a coolant or coolants in accordance with a signal from said monitor.

9. The cooling controller defined in claim 8 further comprising coolant nozzles positioned to apply said coolant or coolants to rolls positioned at said outlet roll bites.

10. A cold rolling mill comprising the cooling controller defined in claim 8 and at least a pair of rolls forming said outlet rolls bites.

11. The cooling controller defined in claim 9 wherein said rolls are selected from the group consisting of work rolls, intermediate rolls, backup rolls, bearing rolls and wiper rolls.

* * * * *